US006521396B2

(12) United States Patent
Sunny et al.

(10) Patent No.: US 6,521,396 B2
(45) Date of Patent: Feb. 18, 2003

(54) PHOTOGRAPHIC CHEMICAL FORMULA AND PROCESS

(75) Inventors: Yan Man Chi Sunny, Kowloon (HK); Wing Man Yu, Kowloon (KR)

(73) Assignee: Hong Kong Polytechnic University, Kowloon (HK)

( * ) Notice: Subject to any disclaimer, the term of this patent is extended or adjusted under 35 U.S.C. 154(b) by 23 days.

(21) Appl. No.: 09/811,835

(22) Filed: Mar. 20, 2001

(65) Prior Publication Data

US 2002/0192606 A1 Dec. 19, 2002

(51) Int. Cl.[7] ..... G03C 5/26
(52) U.S. Cl. ..... 430/439; 430/486
(58) Field of Search ..... 430/439, 486

(56) References Cited

U.S. PATENT DOCUMENTS 4,440,852 A * 4/1984 Onishi et al. ..... 430/522
5,385,811 A * 1/1995 Hirano ..... 430/438

* cited by examiner

*Primary Examiner*—Hoa Van Le
(74) *Attorney, Agent, or Firm*—Leydig, Voit & Mayer, Ltd.

(57) ABSTRACT

High density and contrast range photographic grids for a moiré body scanner are made by a method including forming an image on a high density technical grade film, providing a recommended commercial developer chemical for said high density technical grade film, preparing a modified developer liquid from said recommended commercial developer chemical by increasing the pH and the contrast of developer reducing agent, and developing a black and white image using said modified developer liquid. The modified developer liquid also finds other applications.

2 Claims, No Drawings

PHOTOGRAPHIC CHEMICAL FORMULA AND PROCESS

The present invention relates to a photographic process. It particularly relates to a photographic process achieving minimum fog levels and high resolution under high density conditions. Photographic chemical developer formulae for the process are also part of this invention.

BACKGROUND OF THE INVENTION

The photographic chemical process is essentially the reduction of grains of exposed silver halide to metallic silver according to the equation:

$$Ag^{+}+electron=Ag\ (metal).$$

The normal development reduces only exposed grains containing a latent image. In practice, if development is extended over a long enough period of time, all the grains are developed. The development of the latent image is a rate phenomenon, since the development of the exposed grain takes place at a greater rate than the development of the unexposed grains. Due to this phenomenon, the unexposed silver halide may form the basic minimum density on the film base after film development. In order to make a reducing agent be a developer, it must fall within the proper range of reducing agent power. If it is too weak, it cannot reduce silver halide at all. If it is too powerful, it will immediately reduce the unexposed grains as well as the exposed grains.

The basic density produced by the rate phenomenon is named as the Fog Level. It may cause two specific effects if the rate of this density is higher. First, the greater the light opacity rates, the lower the light transmission at those unexposed areas. Second, this greater density will lower the contrast range between the toe and the shoulder of film density scale.

Fog Levels and related criteria are important for the Body Scanner, which forms the subject of U.S. Ser. No. 09/684,340 filed on Oct. 10, 2000. We incorporate that pending patent application by reference. It claims a compact moiré effect body scanner for generating 3-D contour images, the scanner including an elongate projection module having a light source, a aspherical style condenser lens for directing a beam of light from the flash light source with around 1600 to 2000 joules of light intensity through the heat absorptive glass along the first central longitudinal axis, the first optical glass made photographic grid for the beam of light and mounted in a plane at right angle to the first central axis, it allows the light source passing through the equal space monochrome photographic grid plane of high density, this monochrome image is projected onto a body surface to be scanned by wide coverage objective lens, and an elongate imaging module adjacent to the projection module having a second central longitudinal axis parallel to the first central axis, the imaging module incorporating a second objective lens with the same optical design, focal length and aperture as the projection one for receiving deformed style monochrome grid style images reflected from the body, a second photographic grid is the same as the projection one for the reflected light and mounted in a plane at right angle to the second central axis, and an imaging means for recording the reflected deformed grating from the body captured beyond the second photographic grid.

This scanner invention relates particularly to the compact design of photographic 3D body scanner that is capable of forming accurate moiré topographic images from human body surface in the shortest distance, the shortest duration and the lowest cost, as compared to similar products in market. Such technology may be used in other fields such as surgery or pathology where 3-dimensional information is required.

It is also feasible to operate under normal room light condition. The high speed pulse light with visible spectrum is used as a safe light source. The scanner system can capture the 3D human body images in short distance down to 1.2 m quickly. The duration of pulse light is in between 1/1500 to 1/1600 second. The scanner is physically compact, light weight and relatively low in cost.

The moiré body scanner finds particular utility in selection of garments. Customers of clothing demand well-fitting garments as a fundamental requirement. The success of any retailers, especially an international one, depends largely on their ability to develop products that cater as wide range of consumers as possible. Before this can be achieved, it is essential to know the average body measurements and figure types of the customers. This is usually achieved by conducting extensive human body size surveys, ideally every lo years. Using the existing mechanism, this can be a costly and time-consuming process.

However, with use of the moiré body scanner of the incorporated patent application, the whole process is simplified, the cost is reduced, and the results are accurate and reliable. In particular;

- The size of the scanner is small enough for easy transportation and installation, which can be carried around the country to gain regional data with minimum cost and maximum efficiency. It is also ideal to be placed in-store, allowing retailers to carry out survey on 'real' customers in a convenient location and familiar environment.
- The simple operating technique means that the scanner can be operated by in-house personnel, and does not require supervision from the developer or supplier.
- It is a quick process that requires little time commitment from the subjects being scanned. As a non-contact measurement tool, the results are more accurate and consistent than using a tape measure, and infinitely quicker to obtain, allowing a large amount of data to be captured in a short period of time.
- The low cost of the scanner makes it accessible to many retailers who cannot afford to commit an extensive size survey. By owning the equipment, they would then conduct and update their data on an on-going basis, rather than every 10 years. This would enable them to offer right fitting for their customers.
- The scanner produces both accurate measurements and body shape information, which is critical for retailers which operate business globally that may require a different base fit depending on location.
- In addition to capturing size survey information, the moiré body scanner can provide other potential applications for the retailers and suppliers.
- There is the opportunity to scan customers in-store, to give them accurate information on which size they should buy and which garment style are best suited to their figure type. This would be particularly beneficial for intimate apparel and giving customers their size information for electronic shopping.
- The scanned image could be used to develop first draft patterns and blocks; to identify the base fit of garments based on the size survey data and average body shape and measurements.
- The scanned image could be used to achieve a better understanding and fit to more specialised items, e.g. maternity wear, or clothing for wheelchair-bound customers.

The data could be highly beneficial in developing made-to-measure garments, where patterns are created directly from the scanned image.

The scanner could be operated in indoor environment with not more than 150 lux of ambient lighting condition.

In summary, the moiré body scanner has a potentially wide range of applications that would benefit both the retailers, suppliers and manufacturers. These include the capture of size survey data in both measurement and shape, customer service opportunities and an aid to cater for business development. The differentiating features set it apart from other scanners in that it is easy to transport and install, simple to operate, obtains data quickly and efficiently, and is very low cost, making it accessible to a wide target audience.

For the Body Scanner, a high density parallel grating is made by using Kodak Technical Pan Film (#2415) as high dense with equal space as master grid plane, and by photographic contact transferring onto the Kodak type #160-01 special glass plate, in order to avoid optical aberration and high light-diffraction factor due to the wide angle of light rays and adjacency of a rear nodal point. Since the thickness of light sensitive emulsion layer of #160-10 is less than 5 microns, it decreases the optical diffraction rate and increases the resolution and contrast of the moiré contour; this improves sharpness of both at the center of the frame and around edges of images. The emulsion is coated on a high quality soda lime type optical flat glass base. It is therefore a highly transparent optical glass exhibiting stable dimension having only 1.5mm thick. This will improve image quality and ensure data accuracy. For the best results, to prevent noise resulting from a high fog level index of photographic silver bromide emulsion, a modified photographic film-developing chemical formula is also applied to achieve a high contrast range of 2.80 to 2.90 at Light Opacity Log E, which produces low fog level and increases the resolution. Multi-coating is used on each air-glass surface with a thickness of ¼ wavelength of the incident light wave within the visible spectrum. This increases the light transmission and reduces reflection rate.

OBJECT OF THE INVENTION

An object of this invention is to provide a new formula of photographic chemical developer allowing the stringent requirements for the high density parallel grating of the Body Scanner to be met. A particular object is to have a contrast index from 2.7 to 2.9 and a low base fog level not exceeding 0.1 (at Light Opacity Log E), when applying photographic film to make high dense grid plane as one of the major element in the Projection Moiré System. Photographic systems meeting these exacting requirements find application in other high resolution photographic procedures.

SUMMARY OF THE INVENTION

According to the present invention, we employ a modified developer to develop the image of a fine grain, high contrast range, high resolution black and white film and photographic light sensitive glass with silver bromide emulsion coated. More specifically, we take a commercial developer and adjust the pH towards alkaline, and increase the concentration of developer.

PREFERRED EMBODIMENTS

In making the grids for the Body Scanner, we prefer to apply Kodak Technical Pan Film (#2415) as a high density with equal space grid plane. This photographic material is one of extremely fine grain and with extremely high resolving power continuous tone monochrome type light sensitive photographic film. It is able to vary contrasts through changes in photographic chemical and different development processes to cover a broad range of applications, as indicated in Kodak publication P-255. This film can be processed by Dektol (D-72), D-19, HC-110, D-76, Versamat 641, Versamat 885, Versaflo, Techindol LC or Pota Developer and obtain contrast range from 0.4 to 2.5 at Light Opacity Log E. As this publication stated that the film can obtain the highest contrast index at 2.5 when it is processed by Kodak Dektol (D-72) developer at 180 seconds and temperature at 20° C. Contrast Index was introduced by Eastman Kodak in 1965, it was used for determining the degree of development for monochrome continuous tone photographic film. Contrast Index is the slope (expressed in tangent values) of a straight line joining two points on the characteristic curve that represent the approximate minimum and maximum densities used in practice, the higher number of index indicates higher contrast, and the lower number is opposite.

We have now invented a photographic chemical formula for developing a silver halide film and glass to obtain the minimum fog level and high resolution at a high-density range condition.

The new process is used to make a highly dense (from 12.5 to 30 line pairs per mm) black and white photographic line grid plane that is applied to a Projection Moiré Topographic body capturing system.

This invention provides a smart technology for the projection moiré topographic system in obtaining high contrast and sharp resolution of 3D moiré images. To achieve this, both the light of projection and detection require to pass through a grid plane with parallel lines of maximum density around 2.7 to 2.9 at light opacity log E and minimum density not exceeding 0.10.

In the new photographic developer formula of chemical process, the Kodak Technical Pan #2415 Black & White film is selected to make a high contrast and resolution master grid plane. The thickness of #2415 film base is only 0.1 mm and the emulsion thickness is not more than 7 microns. Its thinness can reduce optical diffraction rate. The density and contrast range can be adjusted by making use of different film developers. According to Kodak's publication P-255, the highest density range 2.50 can be obtained when the film is processed by the Kodak formula D-72 (dektol) film developer in three minutes. The density range of 2.50 is actually the difference between maximum density 2.7 and minimum density 0.2 (base+fog level). Using the Kodak's formula, the maximum density is fine, but the minimum density 0.2 exceeds the requirement of 0.1. This 0.2 of film basic density reduces the transmission of light especially for the film that is slightly opaque to the light. Therefore, the resolution and contrast of contour images is decreased and noise occurs in the moiré fringes, especially at the edge of the frame.

A lower minimum density can be achieved by shortening the development duration slightly. However, the maximum density will be reduced to around 2.4 which is far out of the requirement. The total contrast will then be lowered and therefore it is not suitable for making a high contrast gird plane.

The preferred novel chemical formula of this invention employs alkali, preferably Sodium Hydroxide, and developer, preferably Hydroquinone, added to the Kodak D-72 formula. Hydroquinone can produce higher contrast and details. Sodium Hydroxide can be used to increase the pH value of the developer from pH 11 to 12. This is to limit the unexposed silver bromide caused by the chemical fog. The new photographic chemical process reduces the minimum density of film to 0.07 and extends the maximum density to 2.91. The contrast range is then increased to 2.84. Under this condition, the developing duration should be prolonged and adjusted to 220 seconds. The result of high contrast and transparency can then bring a high resolution of the moiré contour images.

This innovation has been applied as a crucial optical element in the development of a non-contact 3D moiré camera for capturing 42 cm(W)×55 cm(H)×23 cm(D) coverage of human body at a short distance of 80 to 120 cm.

EXAMPLES OF THE INVENTION

The composition of D-72 is as follows:

| | | |
|---|---|---|
| a) | Water in 52° C. | 750.0 ml |
| b) | Metol (Monomethyl Para-Aminophenol Sulfate) | 3.0 gm |
| c) | Sodium sulfite, Anhydrous | 45.0 gm |
| d) | Hydroquinone | 12.0 gm |
| e) | Sodium Carbonate, monohydrate | 80.0 gm |
| f) | Potassium Bromide | 2.0 gm |
| g) | Add cold water (from 10° C. to 20° C.) to make total 1000 ml at 20° C. | |

By using D-72 developer stock solution to process the film at 20° C., the developing duration was 180 seconds, the maximum density is 2.70, and the fog level is 0.17, the contrast index is 2.53 (test by X-rite 820 densitometer). This result cannot fulfill the requirement to produce the high dense grid in good condition. Through our research and test, we found that photographic film developer formulas can be adjusted to customise the fog level and the contrast range by changing the pH value. In addition, adding an accelerator can reduce the development time and increase the contrast. The difference of film development duration and variable temperature can also change the maximum density and increase the contrast index of photographic film.

For this purpose, we add into the D-72 formula 14 gm of NaOH to increase the pH value and recompose the rate between Metol and Hydroquinone, to slightly increase Hydroquinone from 12.0 gm to 15.0 gm. Hydroquinone is a slow, powerful developing agent that is used alone where high density and contrast are required. It is often used with Metol. When it is used alone, it will greatly be retarded by low temperature at around 13° C. At 21° C. or above, excessive fog and stain may be encountered. Finally, the pH value of the modified developer was increased to 11.8 to 12.0 (measured by Extect Microcomputer pH Vision 246072 at 20C) from D-72 pH 11.0. Making use of the modified developer to process the film under 18C, the developing duration is extended from 180 to 220 seconds. The result of contrast index is increased from 2.53 to 2.84, the fog level is 0.07, the maximum density is 2.91 (Test by X-rite 820 densitometer). This result can well be suited to process the Technical Pan Film as the high dense with low fog-level grid plane.

Our modified compositionis as follows:

| | | |
|---|---|---|
| (1) | Distil water in 52° C. | 750.0 ml |
| (2) | Metol | 3.0 gm |
| (3) | Sodium sulfite, Anhydrous | 45.0 gm |
| (4) | Hydroquinone | 15.0 gm |
| (5) | Sodium carbonate, monohydrate | 80.0 gm |
| (6) | Potassium bromide | 2.0 gm |
| (7) | Sodium hydroxide | 14.0 gm |
| (8) | Add cold water (from 10° C. to 20° C.) to make total 1000 ml at 20° C. | |

There are no other similar photographic types of light sensitive film products produced by companies such as Agfa, Fuji, Oriental, Peterson, Willcock, Ilford or Konica. These companies have some similar high contrast type film developers.

Willcock, Ilford or Konica. These companies have some similar high contrast type film developers.

Ansco A-70

Part A:

| | |
|---|---|
| (1) Water | 750 ml |
| (2) Potassium Metasulfite | 25 gm |
| (3) Hydroquinone | 25 gm |
| (4) Potassium bromide | 25 gm |
| (5) Add cold water to make total 1000 ml | |

Part B:

| | |
|---|---|
| (1) Water | 750 ml |
| (2) Sodium Hydroxide | 36 gm |
| (3) Add cold water to make total 1000 ml | |

Ilford ID-13

| | |
|---|---|
| (1) Water | 750 ml |
| (2) Potassium Metasulfite | 12.5 gm |
| (3) Hydroquinone | 12.5 gm |
| (4) Potassium Hydroxide | 2.5 gm |
| (5) Potassium Bromide | 12.5 gm |
| (6) Add cold water to make total 100 ml | |

Kodak D-8

| | |
|---|---|
| (1) Water | 750 ml |
| (2) Sodium Sulfite Anhydrous | 90 gm |
| (3) Hydroquinone | 45 gm |
| (4) Sodium Hydroxide | 37.5 gm |
| (5) Potassium Bromide | 30 gm |
| (6) Add cold water to make total 1000 ml | |

Kodak D-9

Part A:

| | |
|---|---|
| (1) Water | 750 ml |
| (2) Sodium bisulfite | 22.5 gm |
| (3) Hydroquinone | 22.5 gm |
| (4) Potassium Bromide | 22.5 gm |
| (5) Add cold water to make total 1000 ml | |

Part B:

| | |
|---|---|
| (1) Water | 750 ml |
| (2) Sodium Hydroxide | 52 gm |
| (3) Add cold water to make total 1000 ml | |

Kodak D-19

| | |
|---|---|
| (1) Water | 500 ml |
| (2) Metol | 2 gm |
| (3) Sodium sulfite, Anhydrous | 90 gm |
| (4) Hydroquinone | 9 gm |
| (5) Sodium carbonate, monohydrate | 52.5 gm |
| (6) Potassium Bromide | 5 gm |
| (7) Cold water to make total 1000 ml | |

-continued

| Ilford ID-72 | |
|---|---|
| (1) Water | 750 ml |
| (2) Sodium Sulfite, Anhydrous | 72 gm |
| (3) Hydroquinone | 8.8 gm |
| (4) Phenidone | 0.22 gm |
| (5) Sodium carbonate, monohydrate | 48 gm |
| (6) Potassium Bromide | 4 gm |
| (7) Benzotriazole | 0.1 gm |
| (8) Cold water to make total 1000 ml | |
| **Willcock No. 2** | |
| (1) Water | 750 ml |
| (2) Sodium sulfite, anhydrous | 100 gm |
| (3) Hydroquinone | 30 gm |
| (4) Phenidone | 1.5 gm |
| (5) Potassium Hydroxide | 25 gm |
| (6) Potassium Bromide | 3.5 gm |
| (7) Benzotriazole | 0.1 gm |
| (8) Cold water to make total 1000 ml | |

Such other developers can be modified in accordance with the present invention. For preference, the pH is increased by 0.5 to 3, more typically 1 or 2 units. Alkali such as sodium hydroxide can be employed to adjust the pH. For preference, the level of hydroquinone is increased by 10 to 40wt %, more typically 20 to 30wt %, such as 25wt %.

What is claimed is:

1. A method of developing a black and white high resolution film using a recommended liquid developer solution containing a reducing agent which method comprises increasing the pH of said liquid developer and increasing the content of reducing agent in said developer solution, wherein the developer solution has the following composition:

Distilled water at 52° C. 750.0 ml,

Metol (Monomethyl Para-Aminophenol Sulfate) 3.0 gm,

Sodium sulfite, Anhydrous 45.0 gm,

Hydroquinone 15.0 gm,

Sodium carbonate, monohydrate 80.0 gm,

Potassium bromide 2.0 gm,

Sodium hydroxide 14.0 gm, and

Cold water (from 10° C. to 20° C.) to make a total of 1000 ml at 20° C.

2. A method of preparing high density and contrast range photographic grid for a moiré body scanner, the method including forming an image on a high density technical grade film, providing a recommended commercial developer chemical for said high density technical grade film, preparing a modified developer liquid from said recommended commercial developer chemical by increasing the pH and the contrast of developer reducing agent, and developing a black and white image using said modified developer liquid, wherein the resultant photographic grid meets at least one of the following quality control values:

the minimum density of film is from 0.07 to 0.1, the maximum density of film is 2.91 to 2.95, and the contrast range is 2.81 to 2.85.

* * * * *